US006016965A

United States Patent [19]

Yoshimura et al.

[11] Patent Number: 6,016,965

[45] Date of Patent: Jan. 25, 2000

[54] VEHICLE COOLING SYSTEM WITH ELECTRIC MOTOR OVERCURRENT INHIBITING CONTROL

[75] Inventors: Satoshi Yoshimura, Kariya; Junji Sugiura, Toyota; Toshiki Sugiyama, Kariya; Kazuhiro Takeuchi, Okazaki, all of Japan

[73] Assignee: Denso Corporation, Kariya, Japan

[21] Appl. No.: 09/211,413

[22] Filed: Dec. 15, 1998

[30] Foreign Application Priority Data

Dec. 22, 1997 [JP] Japan ..... 9-353409

[51] Int. Cl.[7] ..... F01P 7/04

[52] U.S. Cl. ..... 236/35; 361/24; 361/31; 123/41.12

[58] Field of Search ..... 236/34, 35, DIG. 9, 236/94; 361/23, 24, 31; 318/434; 165/300, 287; 123/41.02, 41.11, 41.12

[56] References Cited

U.S. PATENT DOCUMENTS

| | | | |
|---|---|---|---|
| 4,329,725 | 5/1982 | Hart | 361/31 X |
| 4,590,772 | 5/1986 | Nose et al. | 236/35 X |
| 4,651,922 | 3/1987 | Noba | 236/35 |
| 4,752,851 | 6/1988 | Ritter | 361/31 |
| 5,448,143 | 9/1995 | Pecone | 318/434 |

FOREIGN PATENT DOCUMENTS 4-365923 12/1992 Japan .

*Primary Examiner*—Harry B. Tanner
*Attorney, Agent, or Firm*—Harness, Dickey & Pierce, PLC

[57] ABSTRACT

A vehicle cooling system including a motor control apparatus that controls operation of a system motor when a cooling fan driven by the motor locks due to foreign matter interference or freezing. When motor input current is detected to be overcurrent, the controller limits the current flow. When current flowing to the electric motor is detected to be overcurrent and ambient air temperature is at or above a predetermined temperature, the controller stops energization of the motor. Thus, when the cooling fan freezes and locks, energization of the motor is maintained until ambient air temperature reaches or exceeds the predetermined temperature. Therefore, when the frozen-locked state is eliminated due to a subsequent temperature rise, an ordinary operating state can again be obtained without the controller subsequently detecting surge current, generated as a result of the motor being re-started from a fully stopped state, as overcurrent and therefore incorrectly stopping motor energization. Additionally, when locking occurs due to foreign matter interfering with fan rotation, an overcurrent state is detected even when ambient air temperature is at or above the predetermined temperature, and motor energization is immediately stopped.

19 Claims, 6 Drawing Sheets

VEHICLE COOLING SYSTEM WITH ELECTRIC MOTOR OVERCURRENT INHIBITING CONTROL

CROSS-REFERENCE TO RELATED APPLICATION

This application is related to and claims priority from Japanese Patent Application Hei. 9-353409, the contents of which are incorporated herein by reference.

BACKGROUND OF THE INVENTION

1. Field of the Invention

The present invention relates generally to vehicle cooling systems, and more particularly to control of a cooling system fan motor during a motor lock state.

2. Description of the Related Art

Conventionally, in an automotive cooling system, a fan is operated to cool refrigerant flowing through a system heat exchanger. The current flowing to the fan motor (hereinafter motor input current) is monitored, and the motor, and thus the fan, are stopped when an overcurrent level is detected.

The above-mentioned motor overcurrent may be caused when the cooling fan freezes and locks, as well as when the cooling fan locks due to debris, gravel, or other foreign matter.

System drive requests for the cooling fan are broadly divided into engine cooling requests and air-conditioner refrigerant cooling requests. In the above-described apparatus, when the motor input current is at an overcurrent level when the motor is frozen and locked during an air-conditioner refrigerant cooling fan-drive request, the electric motor is stopped. Consequently, the electric motor cannot be driven again even if temperature within the engine compartment rises and an engine cooling fan-drive request is generated unless the motor is re-started from a completely stopped state.

SUMMARY OF THE INVENTION

In light of the foregoing problem, it is an object of the present invention to control a vehicle cooling system electric motor when a cooling fan that is rotated by the motor locks due to interfering foreign matter or freezing.

To achieve the foregoing object, the present invention provides a temperature sensor to detect ambient air temperature of a cooling fan environment, and a motor-control unit to control motor input current when overcurrent is detected, and to stop the motor when current flowing to the electric motor is detected to be overcurrent and the detected air temperature is greater than or equal to a predetermined temperature.

When the cooling fan has frozen and locked, motor energization is maintained until the ambient air temperature rises to or above the predetermined temperature. Therefore, when the locked state is eliminated due to a subsequent temperature rise, an ordinary operating state can again be obtained. Additionally, when motor input current is detected to be overcurrent, even when the ambient air temperature reached or surpassed a predetermined temperature, it is determined to be locked due to the presence of foreign matter, and the motor energization is upped. Consequently, motor control can be executed when the cooling fan has locked due to either the presence of foreign matter or due to freezing.

Alternatively, when motor input current is detected to be overcurrent and while ambient air temperature detected by the ambient air-temperature sensor is lower than a predetermined temperature, the motor-control unit may limit current flowing to the electric motor. Therefore, control of the electric motor can be carried out appropriately when the cooling fan has locked due to foreign matter or freezing.

Further, when the electric motor is stopped after an overcurrent state has continued for a fixed time interval, erroneous motor stoppage due to surge current immediately after motor actuation can be prevented. In such a case, the above-described predetermined temperature is set at a temperature whereat thawing of the cooling fan can be completed within the fixed time interval when the ambient air temperature reaches the predetermined temperature. Consequently, when frozen and locked, the cooling fan can be thawed within the fixed time interval, and so motor stoppage due to overcurrent detection can be inhibited.

The ambient air-temperature sensor can be mounted together on a circuit board along with a circuit element as an electric motor control unit. When mounted together, the resulting configuration is simplified when compared to a configuration in which the sensor is separately provided.

DETAILED DESCRIPTION OF THE INVENTION

Figure 1:
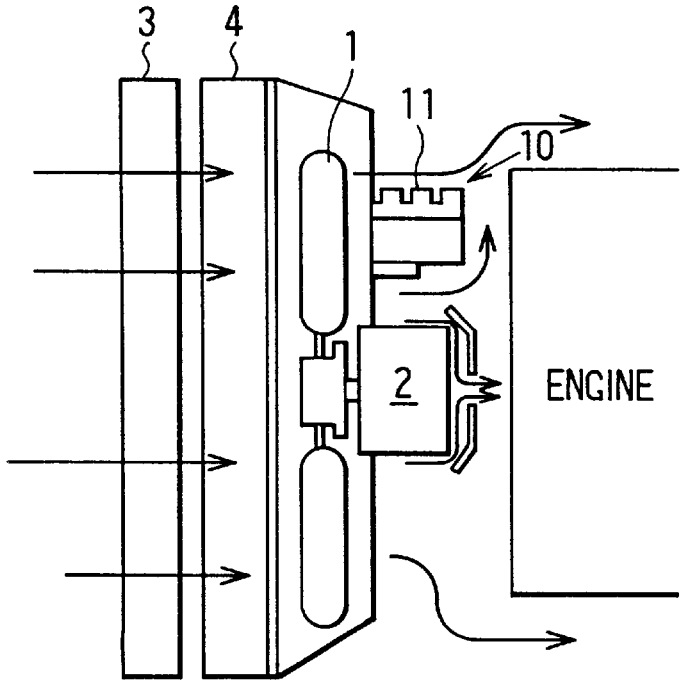
FIG. 1 indicates the mounting configuration of a vehicle cooling system according to a first embodiment of the present invention.

FIG. 1 shows the mounting configuration of a vehicle cooling system according to a first embodiment of the present invention.

The system is provided with a cooling fan 1 and an electric motor 2 to drive the cooling fan 1. A condenser 3 cools refrigerant for air-conditioner use, and a radiator cools engine-coolant water. Both the condenser 3 and the radiator 4 are disposed on the upstream side of the cooling air generated by the cooling fan 1.

Figure 2:
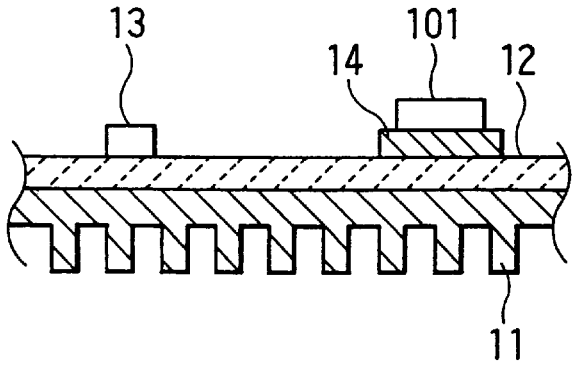
FIG. 2 indicates the structure of a circuit board mounted including a circuit element for controlling an electric motor.

The electric motor 2 is drive-controlled by a motor controller 10. As shown in FIG. 2, this motor controller 10 has a structure wherein circuit elements for controlling the electric motor 2, that is to say, circuit elements of circuits

101–110, are mounted on one surface of the circuit board 12, and a heat-radiating fin 11 is installed on the other surface of the circuit board 12. FIG. 2 depicts a state where a MOS transistor 101 is installed on the circuit board 12 via a heat sink 14. Additionally, an ambient air-temperature sensor 13 is installed on one side of the circuit board 12. The ambient air-temperature sensor 13 detects the ambient air temperature of the environment in which the cooling fan 1 is disposed.

Figure 3:
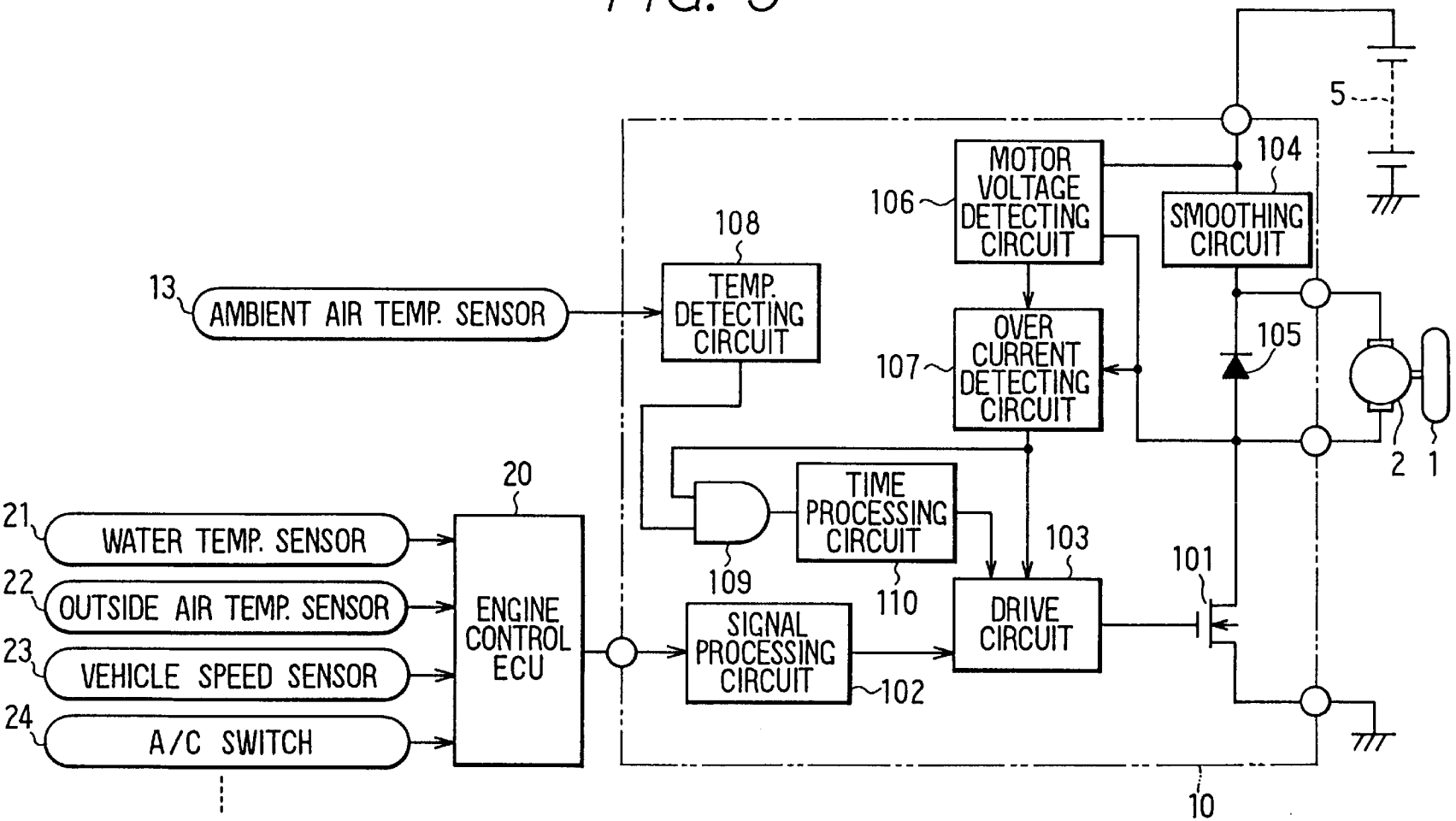
FIG. 3 is a block diagram indicating the electrical structure of the cooling system.

Referring to FIG. 3, the motor controller 10 is activated by power supplied from a vehicle-mounted battery 5 via an ignition switch (not illustrated), and controls the electric motor 2 based on a fan-drive signal output from an engine-control ECU 20. More specifically, the engine-control ECU 20 fetches various sensor signals required to perform engine control and performs such engine control. The ECU 20 also outputs a fan-drive signal in accordance with an engine cooling drive request or an air-conditioner refrigerant cooling drive request, and the motor controller 10 controls the electric motor 2 based on this fan-drive signal. Signals input to the ECU 20 include those from a water-temperature sensor 21 that detects engine-coolant water temperature, an outside-air temperature sensor 22 that detects outside air temperature, a vehicle-speed sensor 23 that detects vehicle speed, an air-conditioner switch 24 that indicates air-conditioner operation, and the like.

The motor controller 10 performs pulse-width modulation (PWM) control of the electric motor 2 based on fan-drive signals from the engine-control ECU 20. For this reason, the motor controller 10 is provided with the MOS transistor 101 as a semiconductor switching element to drive the electric motor 2, a signal-processing circuit 102 to output a voltage-level signal corresponding to a fan-drive signal based on the fan-drive signal from the engine-control ECU 20, a drive circuit 103 to drive the MOS transistor 101 with a duty corresponding to the signal from the signal-processing circuit 102, a smoothing circuit 104 provided to prevent occurrence of conduction noise when switching the MOS transistor 101, and a diode 105 for absorbing counter-electromotive force.

The motor controller 10 is provided with a function to limit motor input current and to stop energization of the electric motor according to a predetermined timing pattern when motor input current becomes overcurrent. For this reason, the motor controller 10 is provided with a motor-voltage detecting circuit 106 to detect voltage applied to the motor, an overcurrent detecting circuit 107 to output a high-level signal when motor input current is detected from the motor-applied voltage and the motor current to be overcurrent, a temperature-detecting circuit 108 to output a high-level signal when ambient air temperature is a predetermined temperature $T_M$ or more according to a signal from the ambient air-temperature sensor 13, an AND gate 109 which obtains the logical product of the signal from the overcurrent detecting circuit 107 and the signal from the temperature-detecting circuit 108, and a time-processing circuit (delay circuit) 110 to output a high-level signal after a fixed time interval when the output of the AND gate 109 has gone high.

Herein, when PWM control is performed for the electric motor 2, the two terminal voltages of the electric motor 2 change according to the on/off state of the MOS transistor 101. Therefore, the motor-voltage detecting circuit 106 is structured to smooth the two terminal voltages of the electric motor 2 and detect the motor-applied voltage.

Figure 4:
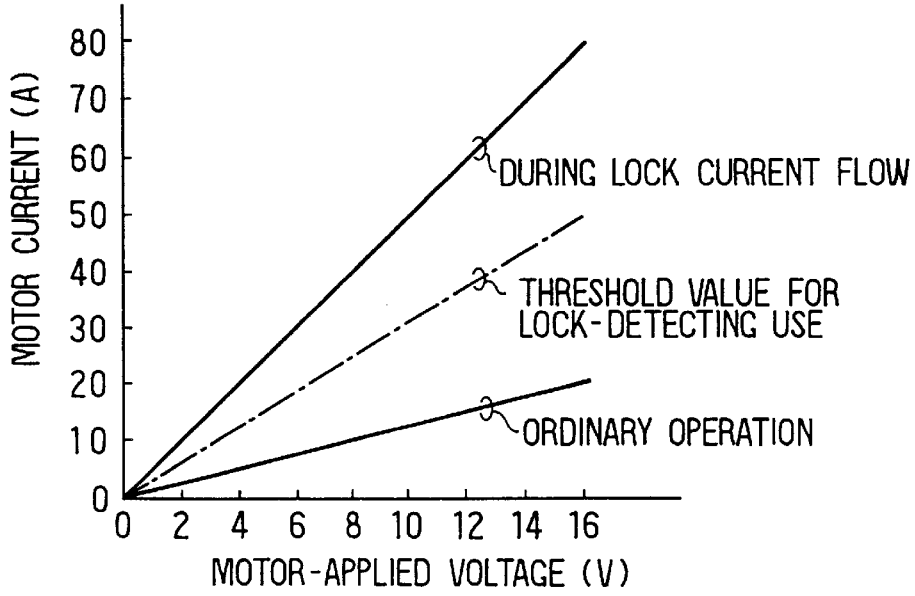
FIG. 4 is a graph of the relationship of motor current to motor-applied voltage.

Additionally, as shown in FIG. 4, the motor input current, that is, the current flowing to the MOS transistor 101, is proportional to the motor-applied voltage. Because lock current flowing to the electric motor 2 at the time of locking increases compared to current during ordinary operation, the overcurrent detecting circuit 107 performs overcurrent detection when the motor current has exceeded a threshold value for lock-detecting use with respect to the motor-applied voltage, and outputs a high-level signal.

According to the present embodiment, the motor current is detected from drain voltage when the MOS transistor 101 switches on, based on an oscillation signal from an oscillator circuit 103*a*. The threshold value for lock-detecting use is not exclusively a value which increases in proportion to the motor-applied voltage, but may be a value which is limited to a fixed value at a predetermined motor-applied voltage or more.

Figure 5:
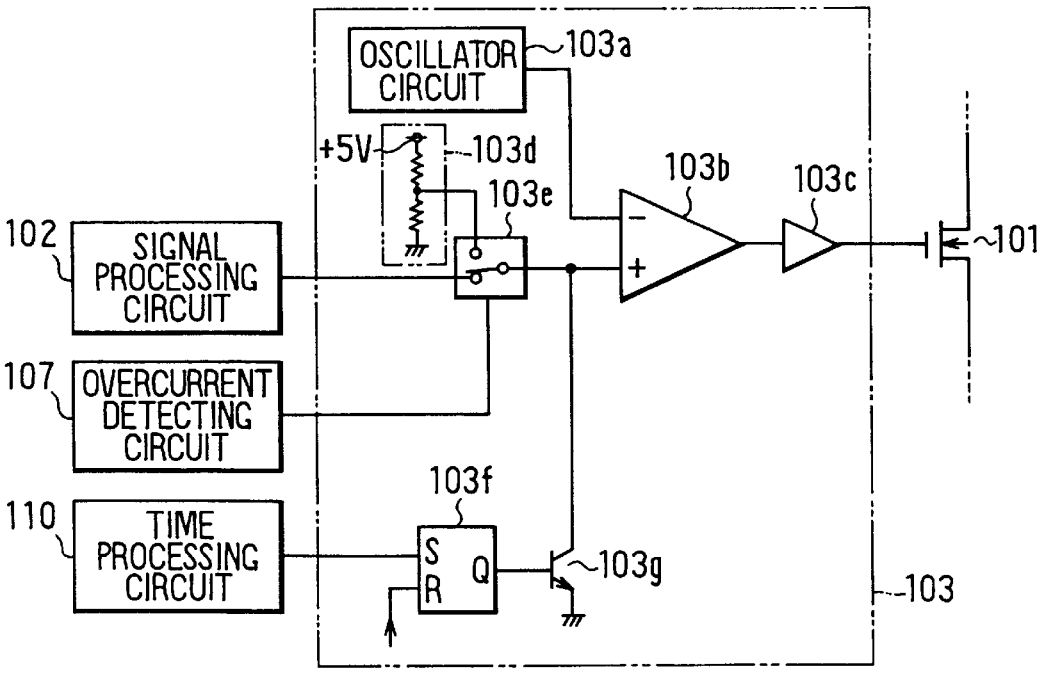
FIG. 5 is a diagram of the specific structure of the drive circuit in FIG. 3.

When a high-level signal is output from the overcurrent detecting circuit 107, the drive circuit 103 limits the motor input current. FIG. 5 shows the specific structure of the drive circuit 103. The drive circuit 103 is provided with the oscillator circuit 103*a* to output a delta-wave signal, a comparator 103*b* to compare this delta-wave signal and the signal output from the signal-processing circuit 102 and output a duty signal corresponding to the level of the signal output from the signal-processing circuit 102, and a buffer 103*c* to apply the output of the comparator 103*b* to the gate of the MOS transistor 101. The drive circuit 103 controls energization of the MOS transistor 101 at a duty in correspondence with the signal output from the signal-processing circuit 102, that is, the fan-drive signal output from the engine-control ECU 20. Additionally, the drive circuit 103 is provided with a reference-voltage generating circuit 103*d* to generate a reference voltage through a voltage-dividing resistor, and a switching circuit 103*e*.

Accordingly, when a high-level signal is output from the overcurrent detecting circuit 107 due to overcurrent detection, the switching circuit 103*e* outputs a reference voltage from the reference-voltage generating circuit 103*d* to the comparator 103*b*. Consequently, the MOS transistor 101 is driven at a fixed duty. At this time, motor input current can be limited to a predetermined value when the reference voltage from the reference-voltage generating circuit 103*d* is set so that the reference voltage becomes lower than the voltage signal output from the signal-processing circuit 102, with the MOS transistor 101 thus being driven at a low duty.

The ambient air-temperature sensor 13 and the temperature-detecting circuit 108 are provided to determine whether the cooling fan may lock due to freezing. The temperature-detecting circuit 108 outputs a low-level signal when the ambient air temperature detected by the ambient air-temperature sensor 13 is lower than the predetermined temperature $T_M$ (for example 50° C.). In this case, the output of the AND gate 109 stays low, and so the output of the time-processing circuit 110 also is maintained at a low state. The output of the time-processing circuit 110 is utilized by the drive circuit 103 to stop energization of the electric motor 2. However, because energization of the electric motor 2 is maintained when the output of the time-processing circuit 110 is low, motor input current is maintained at a limited level while the ambient air temperature detected by the ambient air-temperature sensor 13 is lower than the predetermined temperature $T_M$. In this case, the ambient air temperature is low and the inner temperature of the electric motor 2 is also low, and so the inner temperature of the electric motor 2 does not reach a usage-limit temperature.

In such a state, when a frozen-locked state of the cooling fan 1 is eliminated due to temperature rise within the engine compartment, the motor input current does not reach an overcurrent level, and so the electric motor 2 operates in an ordinary state.

However, when a high-level signal is still output from the overcurrent detecting circuit 107 at a time when the ambient air temperature reaches the predetermined temperature $T_M$ or more, and a high-level signal is output from the temperature-detecting circuit 108, the output of the AND gate 109 goes high, and a high-level signal is output from the time-processing circuit 110 after a fixed time interval $t_L$.

As shown in FIG. 5, the drive circuit 103 is provided with a flip-flop 103*f* and a transistor 103*g*. When a high-level signal is output from the time-processing circuit 110, the flip-flop 103*f* is set and the transistor 103*g* is switched on by an output signal from a Q terminal thereof. Due to this, the voltage of a non-inverting input terminal of the comparator 103*b* becomes 0 V, and so the output of the comparator 103*b* goes low, the MOS transistor 101 switches off, and energization of the electric motor 2 is stopped. That is to say, voltage to the electric motor 2 due to locking caused by foreign matter interfering with the fan, and not due to locking of the fan caused by freezing.

When the detected ambient air temperature reaches or surpasses the predetermined temperature $T_M$, and a high-level signal has been output from the temperature-detecting circuit 108 when a high-level signal has been output from the overcurrent detecting circuit 107, energization of the electric motor 2 is stopped after the elapse of the fixed time interval $t_L$ according to the time-processing circuit 110.

The flip-flop 103*f* shown in FIG. 5 is reset by a reset signal from the ignition-detecting circuit (not illustrated) to detect when the ignition switch has been switched on, or by a reset signal output at the start of output of the fan-drive signal from the engine-control ECU 20.

Figure 6:
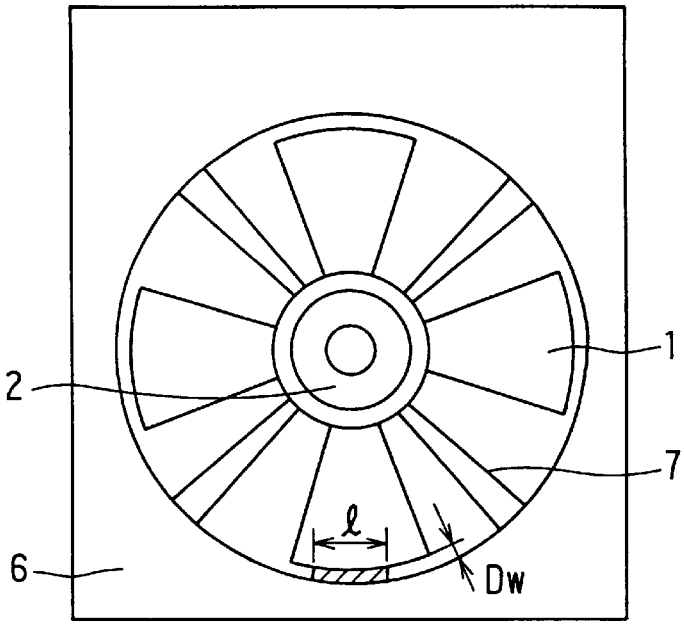
FIG. 6 is an elevation view of the cooling fan indicating a state wherein a water film is formed between the fan and a fan shroud.
Figure 7:
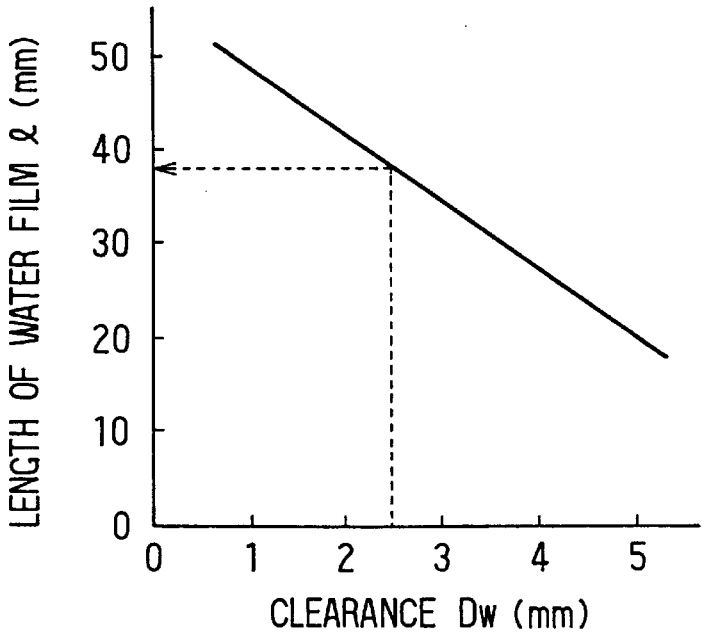
FIG. 7 is a graph of the relationship of maximum length of the water film to clearance between the cooling fan and the fan shroud.
Figure 8:
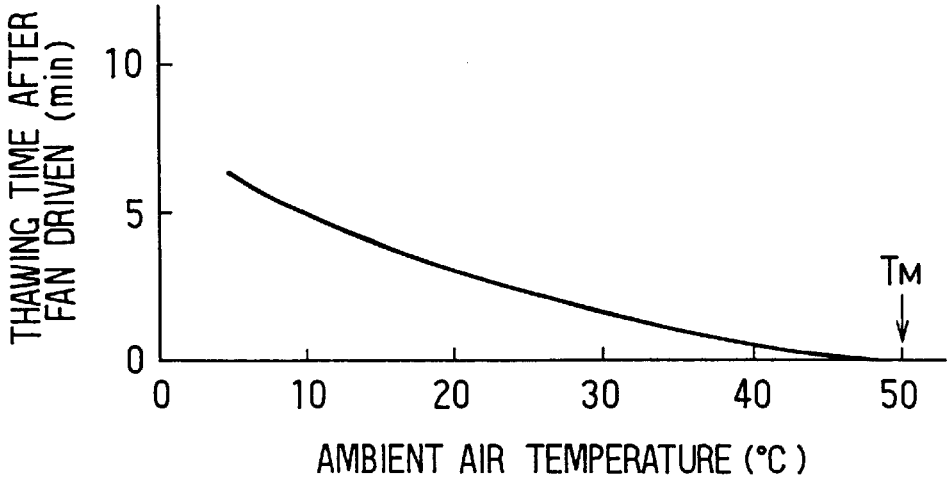
FIG. 8 is a graph of the relationship of thawing time to ambient air temperature.

The above-described predetermined temperature $T_M$ is established as will be described hereinafter. FIG. 6 shows a front view of a cooling-fan apparatus. In the drawing, 6 is a fan shroud to house the cooling fan 1, and 7 is a support stay to support the electric motor 2. A clearance Dw is established between the cooling fan 1 and the fan shroud 6, and maximum length l of a water film (the portion indicated by hatching in the drawing) formed between the cooling fan 1 and the fan shroud 6 is specified in correspondence with this clearance Dw. FIG. 7 shows the relationship between the clearance Dw and the maximum length l of the water film. From this relationship, the maximum length l of the water film can be set at 37 mm when, for example, the clearance Dw is 2.5 mm. When the maximum length l of the water film is taken to be 37 mm and the entirety thereof has frozen, the relationship of thawing time to the ambient air temperature is as shown in FIG. 8. From this relationship, the predetermined temperature $T_M$ is set at 50° C. In other words, when the ambient air temperature is 50° C., the cooling fan 1 can be thawed within the fixed time interval $t_L$ according to the above-described time-processing circuit 110. Stated another way, a temperature of 50° C. is one at which, even if frozen, momentary thawing can occur within the fixed time interval $t_L$ according to the time-processing circuit 110.

Figure 9:
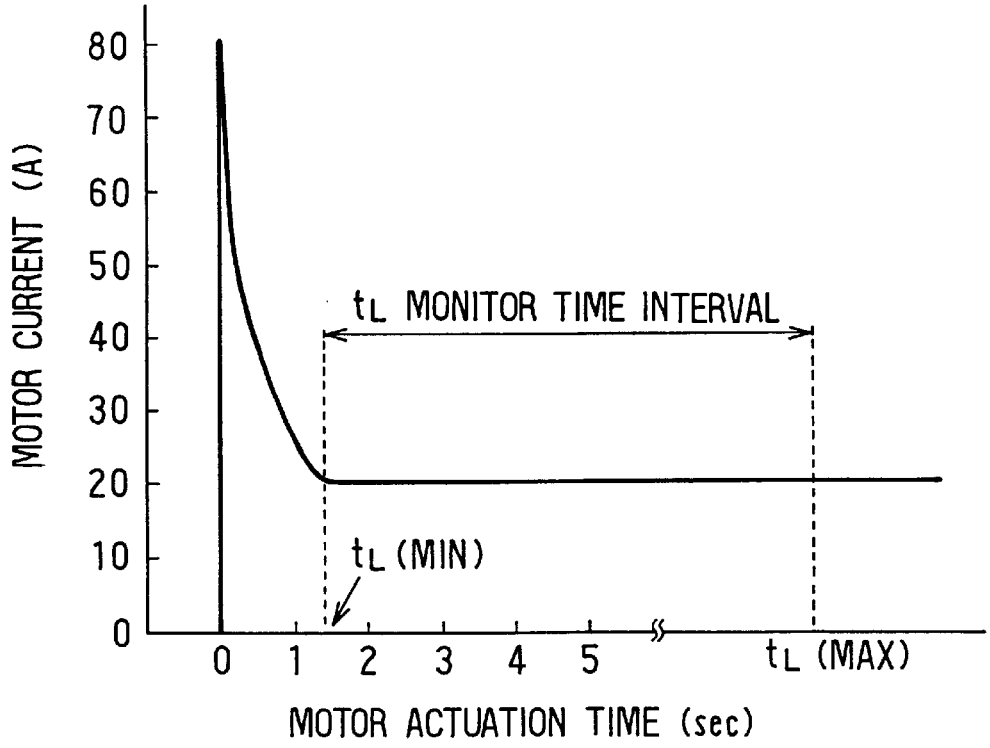
FIG. 9 is a graph of the relationship of motor current to motor-actuation time.
Figure 10:
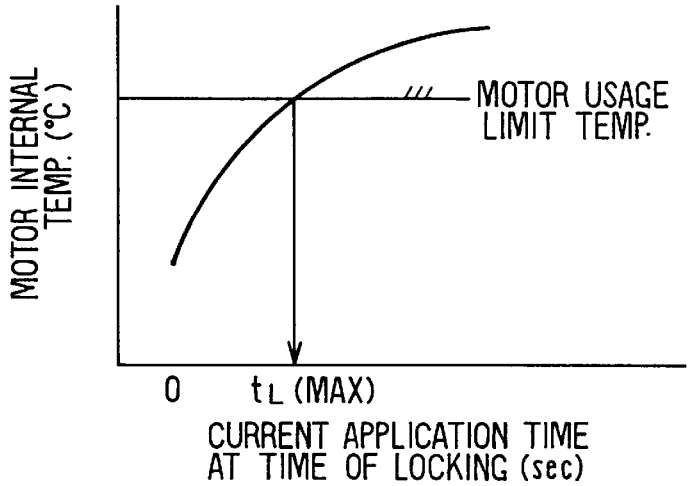
FIG. 10 is a graph of the relationship of motor internal temperature to locking current application time.

Additionally, the fixed time interval $t_L$ in the above-described time-processing circuit 110, that is, the monitor time interval $t_L$ for foreign-matter lock determination, is established as will be described hereinafter. FIG. 9 shows change in motor current with respect to motor-actuation time. Because surge current occurs immediately after motor actuation, the minimum value of the monitor time interval $t_L$ is set so as not to stop energization due to erroneous detection. Additionally, FIG. 10 shows the relationship of motor internal temperature to current-application time at the time of locking. When current-application time at the time of locking becomes longer, the internal temperature of the electric motor 2 rises. The internal temperature of the electric motor 2 reaches the maximum value of the monitor time interval $t_L$ immediately before reaching the motor usage-limit temperature. Consequently, the monitor time interval $t_L$ is set between the above-mentioned minimum value and maximum value, and can be set for example at 3.2 sec.

According to the above-described embodiment, when the motor input current is detected to be overcurrent, the motor controller 10 limits the motor input current; when the motor input current is detected to be overcurrent even when the ambient air temperature reaches or surpasses the predetermined temperature $T_M$, the motor controller 10 stops energization of the electric motor 2. Due to this, in a case where the cooling fan 1 has frozen and locked, energization of the electric motor 2 is not stops immediately due to overcurrent detection, but rather is maintained until the ambient air temperature reaches the predetermined temperature $T_M$ or more. Therefore, when the frozen-locked state is eliminated due to subsequent temperature rise, an ordinary operating state is obtained.

Additionally, when locking occurs due to foreign matter interfering with the fan, the motor input current flowing to the electric motor 2 is detected to be overcurrent even when the ambient air temperature is at or above the predetermined temperature $T_M$. Therefore, energization of the electric motor 2 is immediately stopped.

Figure 11:
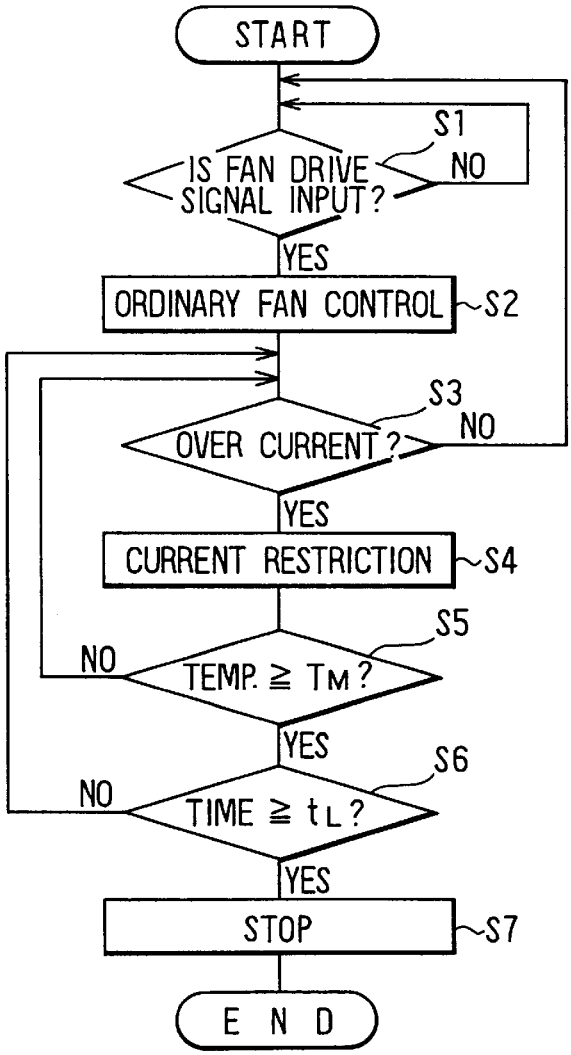
FIG. 11 is a flow diagram indicating processing for an embodiment including a microprocessor.

Further, the above-described embodiment can utilize a structure having a microprocessor or the like as a computing unit in the motor controller 10. In such a configuration, processing is performed as shown in the flow diagram of FIG. 11. Namely, when it is determined that a fan-drive signal has been input from the engine-control ECU 20 (step S1), PWM control of the MOS transistor 101 is performed in accordance with the fan-drive signal (step S2). Accordingly, it is determined whether the motor input current is overcurrent from the motor current and the motor-applied voltage detected by the motor-voltage detecting circuit 106 (step S3). When determined to be overcurrent, the MOS transistor 101 is driven at a fixed duty, and the motor input current is limited (step S4). Accordingly, it is determined by a signal from the ambient air-temperature sensor 13 whether the ambient air temperature is the predetermined temperature $T_M$ or more (step S5). When a determination of overcurrent is made while the ambient air temperature is lower than the predetermined temperature $T_M$, the current-limition state is maintained. Accordingly, when the ambient air temperature rises to or above the predetermined temperature $T_M$, it is determined whether the monitor time interval $t_L$ has elapsed (step S6). When the monitor time interval $t_L$ is determined to have elapsed, energization of the MOS transistor 101 is stopped (step S7).

In the above-described embodiment, an apparatus performing control for a single electric motor was described. However, control may be performed similarly for two or more electric motors.

Further, while the above description constitutes the preferred embodiment of the present invention, it should be appreciated that the invention may be modified without departing from the proper scope or fair meaning of the accompanying claims. Various other advantages of the present invention will become apparent to those skilled in the art after having the benefit of studying the foregoing text and drawings taken in conjunction with the following claims.

What is claimed is:

1. A vehicle cooling system, comprising:

a fan to cool a vehicle heat exchanger;

an electric motor to drive the fan;

means for controlling energization of the electric motor; and a sensor to detect air temperature of a fan environment;

wherein the controlling means limits electrical motor input current when the current is detected to be overcurrent and the detected air temperature is below a predetermined temperature, and the controlling means stops the energization of the motor when the current is detected to be overcurrent and the detected air temperature is at or above the predetermined temperature.

2. The system of claim 1, wherein the controlling means includes a circuit element mounted on a circuit board for controlling the energization of the electric motor;

the circuit board is exposed to air passing through the heat exchanger; and the air-temperature sensor is provided on the circuit board.

3. The system of claim 1, wherein the control means comprises a controller including:

a semiconductor switching element to drive the motor;

a signal processing circuit to output a voltage signal corresponding to a fan drive signal; and a drive circuit to drive the semiconductor switching element with a duty corresponding to the voltage signal output from the signal processing circuit.

4. The system of claim 3, wherein the drive circuit includes an oscillator to output an oscillating signal;

a comparator to compare the oscillating signal to the voltage signal output by the signal processing circuit, and to subsequently output a comparator output signal; and a buffer to apply the comparator output signal to the semiconductor switching element to drive the semiconductor switching element.

5. The system of claim 4, wherein the drive circuit further comprises:

a reference voltage generator to generate a reference voltage; and a switch to output the reference voltage to the comparator to drive the semiconductor switching element at a fixed duty.

6. The system of claim 5, wherein the control means sets the reference voltage so that the reference voltage becomes lower than the voltage signal output from the signal processing circuit.

7. The system of claim 6, wherein the drive circuit further includes:

a time delay circuit that causes limited current flow to the motor to be maintained when the temperature is less than the predetermined value;

a flip-flop that is set upon receiving a high level signal from the time processing circuit; and a transistor that is switched on by an output signal from the flip-flop when the flip-flop is set, and that consequently causes an output from the comparator to go low, thereby stopping energization of the motor.

8. An electrical fan cooling system for a motor vehicle, comprising:

a cooling fan to blow air to a vehicle cooling system heat exchanger;

an electric motor to drive the cooling fan;

a controller to control energization of the electric motor and, when motor input current is detected to be overcurrent, to stop energization of the motor; and a sensor to detect ambient air temperature of an environment in which the cooling fan operates, wherein when the motor input current is detected to be overcurrent and the ambient air temperature detected by the sensor is less than a predetermined temperature, the controller limits the motor input current.

9. The system of claim 8, wherein the controller stops energization of the motor when the overcurrent continues for a fixed time interval.

10. The system of claim 9, wherein the predetermined temperature is set so that thawing of the cooling fan can be completed within the fixed time interval when the ambient air temperature reaches the predetermined temperature.

11. An apparatus for controlling a vehicle cooling system fan motor, comprising:

a controller that limits electrical input motor current when the current is detected to be overcurrent and the sensed cooling environment air temperature is below a predetermined temperature, and that stops energization of the motor when the current is detected to be overcurrent and the detected air temperature is at or above the predetermined temperature.

12. The apparatus of claim 11, wherein the controller includes:

a switching element to drive the motor;

a signal processing circuit to output a voltage signal corresponding to a fan drive signal; and a drive circuit to drive the switching element with a duty corresponding to the voltage signal output from the signal processing circuit.

13. The apparatus of claim 11, further comprising an electromotive force absorbing element connected across inputs of the motor for absorbing counter-electromotive force generated by the motor.

14. The apparatus of claim 11, wherein the drive circuit includes an oscillator circuit to output an oscillating signal;

a comparator to compare the oscillating signal to a signal output by the signal processing circuit, and to subsequently output a comparator output signal; and a buffer to apply the comparator output signal to an input of the switching element.

15. The apparatus of claim 14, wherein the drive circuit further comprises:

a reference voltage generating circuit that generates a reference voltage; and a switching circuit that outputs the reference voltage to the comparator to drive the switching element at a fixed duty.

16. The apparatus of claim 15, wherein the controller sets the reference voltage so that the reference voltage becomes lower than the voltage signal output from the signal processing circuit.

17. The apparatus of claim 16, wherein the drive circuit further includes a flip-flop that is set after receiving a high level signal from the time processing circuit; and a transistor that is switched on by an output signal from the flip-flop when the flip-flop is set, and that consequently causes an output from the comparator to go low, thereby stopping energization of the motor.

18. A method of controlling a motor of a cooling fan in a vehicle cooling system, comprising the steps of:

monitoring current supplied to the motor as the motor drives the fan;

detecting an ambient air temperature of a cooling fan environinment;

limiting the current when the current is detected to be overcurrent; and stopping the current when the current is detected to be overcurrent and when the temperature is detected to be at or above a predetermined temperature.

19. The method of claim 18, further comprising the step of stopping the current after the step of limiting if a predetermined time period has elapsed.

* * * * *